United States Patent [19]

Jacobsson

[11] 4,259,852

[45] Apr. 7, 1981

[54] POSITIVE THREAD-DELIVERY DEVICE FOR STRIPE KNITTING MACHINES

[75] Inventor: Kurt A. G. Jacobsson, Ulricehamn, Sweden

[73] Assignee: Aktiebolaget IRO, Ulricehamn, Sweden

[21] Appl. No.: 68,352

[22] Filed: Aug. 21, 1979

[30] Foreign Application Priority Data

Aug. 22, 1978 [DE] Fed. Rep. of Germany ..... 2836716

[51] Int. Cl.[3] ..... D04B 15/48; D04B 15/50

[52] U.S. Cl. ..... 66/132 T; 242/47.01; 66/163; 66/160; 200/61.18

[58] Field of Search ..... 66/132 T, 132 R, 146, 66/137, 158, 160, 163, 161; 242/47.01; 200/61.18

[56] References Cited

U.S. PATENT DOCUMENTS

| | | | |
|---|---|---|---|
| 1,358,483 | 11/1920 | Wachsman | 66/161 |
| 3,264,845 | 8/1966 | Rosen | 66/132 |
| 3,343,008 | 9/1967 | Bancroft | 200/61.18 X |
| 3,418,831 | 12/1968 | Nance | 66/132 |
| 3,521,265 | 7/1970 | Bancroft | 200/61.18 X |
| 3,802,228 | 4/1974 | Deniega | 66/132 T |
| 3,922,887 | 12/1975 | Mischon | 66/132 T |
| 3,950,966 | 4/1976 | diCarlo | 66/132 T |
| 4,043,155 | 8/1977 | Stienberg et al. | 66/163 T X |

*Primary Examiner*—Ronald Feldbaum
*Attorney, Agent, or Firm*—Blanchard, Flynn, Thiel, Boutell & Tanis

[57] ABSTRACT

A positive thread-delivery device for a knitting machine, wherein a plurality of thread-guiding rollers are associated with each knitting system, with which one common delivery belt cooperates, wherein with each roller there is associated a thread-control element which, during processing of the thread, holds same in a clamping position between the delivery belt and roller and which during paying out of the thread can be changed over into a position in which it guides the thread over an area of the roller which is free from the delivery belt to thus terminate such delivery, and including a thread-breakage monitor wherein a swivel arm is provided which engages the thread which unwinds from the thread-delivery device, which swivel arm has associated therewith first and second switches operated at different angles of traverse of the swivel arm, the first switch controlling an electromagnet which loads the thread-control element, the second switch stopping the drive of the machine, the first switch being the first one operated during swinging out of the swivel arm from a position assumed during thread delivery, and the second switch being the second one operated during swinging out of the swivel arm.

9 Claims, 1 Drawing Figure

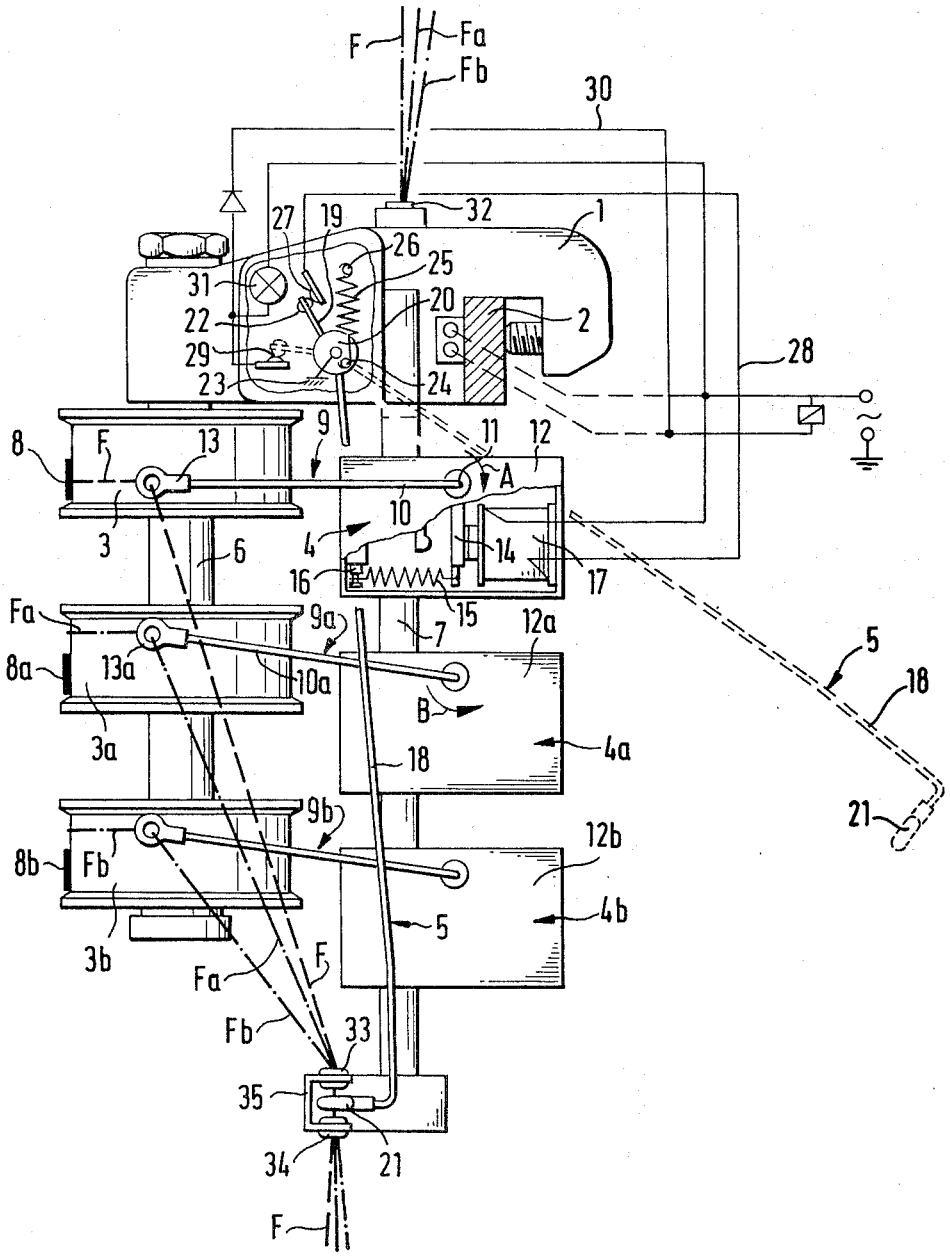
F
Fa
Fb
30
32
1
27
19
26
25
31
20
22
2
29
28
23
24
8
F
13
9
11
12
A
3
10
4
6
14
16
15
17
Fa
9a
7
12a
5
8a
13a
10a
18
B
3a
4a
18
21
9b
12b
8b
Fb
4b
5
3b
Fa
F
Fb
33
35
34
21
F

POSITIVE THREAD-DELIVERY DEVICE FOR STRIPE KNITTING MACHINES

FIELD OF THE INVENTION

The invention relates to a positive thread-delivery device for circular, specifically stripe, knitting machines.

BACKGROUND OF THE INVENTION

A thread-delivery device is known from U.S. Pat. No. 4,027,505. Its thread-control element has two approximately parallel lever arms which are arranged pivotal about a common axis such that their free ends, which are provided with eyelets, extend on both sides of a thread-guiding roller. A spring engages, at a position spaced from the swivel axis, one of the lever arms such that it urges the lever arms in a position in which the eyelets and thus the thread guided through them are in the delivery-belt-free area of the thread roller. The same lever is extended beyond the swivel bearing, and a pull rope is secured on it at one end, the other end of which is connected to a rocking lever in the area of the control system of the knitting machine. The rocking lever is moved into two different end positions through a mechanism by the control members for the needles, depending on whether threads are, or are not, being supplied by the respective system. In the case of thread supply, the rocking lever tensions the pull rope such that it maintains the lever arms of the thread-control element against the force of the spring in a position in which the eyelets are at the level of the delivery belt on the thread roller. During paying out of the thread the rocking lever changes position, whereby the pull rope becomes loose and the spring can relax, so that the thread can move out of the area of the delivery belt, and the thread delivery is interrupted. If thread again is consumed at the respective system, the rocking lever tensions the pull rope and the thread delivery starts again. This known device uses expensive mechanical means. Futhermore the pull ropes, which extend from the thread rollers which are arranged above the working area to the control members which are stored below the working area of the knitting machine, make the working area itself difficult to reach. To monitor thread breakages, an additional thread-breakage monitor as a separate structural part must be arranged to turn off the knitting machine. After the machine has been turned off, thread is still being supplied as long as the delivery belt continues to run due to the inertia of its drive mechanisms. In so far as we are dealing with a turning-off means of a common type, which reacts to a change in the thread tension, it must furthermore differentiate whether it is dealing only with a tension drop during a thread change or indeed with a thread breakage.

Should the thread monitoring occur with one single member, same must interrupt the positive thread delivery during paying out and clamping of the thread, and must stop the machine during thread breakage. If one uses for this a common turning-off means, then same would have to run through a very large swivel path and interrupt the delivery after a first small angle, and stop same after a substantially larger angle. In order to be able to carry out the interruption of the delivery during paying out of the thread as quickly as it is necessary in knitting machines, the turning-off means would have to be pressed with a large spring force against the thread. A large spring force is, however, undesired during this turning off, since the spring force acts directly against the thread tension, which in turn is supposed to be held as small as possible.

It is therefore not advantageous to use a conventional thread-delivery device, as shwon in German AS No. 1,585,298, in which the turning-off arm moves the thread out from between the belt and thread-guiding roller and thereby operates a switching-off means, which switches on only a signalling lamp, while after a substantial further swivel path a second switch is operated, which turns off the machine. This has been used in a circular knitting machine up to now only so as to be able to differentiate between overfeeding to a system and breakage. In the first case only a warning indication is given, in the second case stopping takes place.

The purpose of the invention is to construct a device of the above-described type such that, with simple means and slight tension effect at the thread both during paying out of the thread and also during thread breakage, the thread delivery can be interrupted quickly.

In the inventive device a tension change in the unwinding thread influences directly only the swivel arm, the swivel movements of which are converted into naturally quick electrical switching operations. The first switching operation occurs already during a small angular movement and causes, through the switch and electromagnet, a sudden interruption in the thread delivery. This quick reaction is desired for the normal thread change during the operation of the knitting machine. It has the further advantage that is immediately noticed at the thread feeler whether, in spite of the stopped delivery, the tension drops further, thus a thread breakage exists. Since the swivel movement into the switching-off position is quickly started, and on the other hand the thread delivery is interrupted prior to the switching off of the machine, there is so much time available for the second swivel path that the pretension of the swivel arm can be kept small, as is favorable for low thread tension. The return force which engages, directly or indirectly, the thread control element through the electromagnet for interrupting the thread delivery can, however, be of any desired size and thus can be designed to act quickly since it has no influence on the thread tension.

Particularly, it is possible to quickly interrupt the thread delivery by the swivel arm resting during the thread delivery on the first switch and closing the circuit of the electromagnet, and interrupting the circuit at the start of the swivel movement. With this the thread delivery is interrupted immediately, even in the case of a small tension drop.

The electromagnet can engage, in a simple manner when the circuit is closed, the thread-control element against the force of a spring which loads the thread-control element in the direction of the delivery-belt-free area. The speed, with which the thread delivery is interrupted, is thus determined by the stored spring force, which is not limited by having to pay attention to the thread tension. The thread-control element is moved instantaneously when the thread tension starts to drop and the swivel arm accordingly starts to swivel.

In a preferred embodiment the swivel arm is connected to a rotatable and eccentrically spring-loaded disk and a short lever arm is arranged on same, which lever arm carries a contact piece at its free end. The angular movements of the swivel arm can thus be translated into short switching paths of the contact piece.

The switches and the associated circuits are stored in a small space. This is particularly important for thread-delivery devices on knitting machines since each knitting system of the machine must have associated with it several thread-delivery devices for the different threads which are to be used alternately.

These several thread-delivery devices and associated thread-control elements can be supported advantageously with their thread-breakage monitor on a common support frame.

The electric connection between the electromagnet which is arrranged on the thread-control elements and the switches can be carried out in an advantageously simple manner by the thread-control elements being arranged elevationally movably on a common support rail which projects out from the support frame and the circuits of the associated electromagnets extend along this support rail.

Further details and advantages of the invention can be taken from the description of one exemplary embodiment, which is illustrated in the single FIGURE of the drawing.

BRIEF DESCRIPTION OF THE DRAWING

The single drawing illustrates, in elevational view, a thread-delivery unit associated with a circular knitting machine, which illustrated unit has three thread-delivery devices associated therewith.

DETAILED DESCRIPTION

The drawing illustrates a unit for the delivery of thread to a processing point of a stripe knitting machine, at which processing point threads of different color and/or composition are processed alternately. Therefore the unit has several, in the drawing three, inventive thread-delivery devices for positive thread deliveries. They are arranged on one common support frame 1, which in turn is mounted on a support ring 2 associated with the knitting machine, which ring supports thereon all devices or units for all knitting points of the machine.

All three thread-delivery devices are the same, so that the elements thereof are identified with the same reference numerals except for the addition of the letters "a" and "b" to the elements of the second and third devices, respectively.

Each thread-delivery device includes a thread-guiding roller 3, a thread-control device which as a whole is identified with reference numeral 4, and a thread-breakage monitor (i.e., a stop motion device) which is identified as a whole with reference numeral 5. All three thread-guiding rollers 3, 3*a* and 3*b* are supported rotatably on a common axle 6 which projects down from the support frame 1. The associated thread-control devices 4 4*a* and 4*b* are arranged movably in height on a common support rail 7 which also projects down from frame 1 substantially parallel with axle 6. A drivable delivery belt 8 rests on each thread-guiding roller 3 over a portion of its periphery, which belt loops around all thread-guiding rollers of the units which are arranged at equal height for all processing points of the machine. The delivery belt 8 has a width which corresponds approximately with half the height of the thread-guiding roller 3, so that the thread-guiding roller has a peripheral area which is free from the delivery belt.

The thread-control device 4 has a thread-control element 9 consisting of two arms 10 and a swivel axle 11 which connects said arms in a U-shaped manner. The thread-control element 9 is supported on a housing 12 by means of the swivel axle 11 such that the two arms extend in parallel on opposite sides of the thread-guiding roller 13. Each arm 10 carries on its free end an eyelet 13 for the thread. An arm or lever 14 of magnetic material is secured at its one end to the swivel axle 11, so that the arm projects from the axle at approximately a right angle to the arms 10. A spring 15 engages the free end of the arm 14, which spring is constructed as a tension spring, and the other end of which is secured on the housing 12 by means of a mounting 16. An electromagnet 17 is arranged in the housing 12 adjacent the arm 14 so that it, when switched on, attracts the arm 14 against the force of the spring 15. The circuit of the electromagnetic 17 and the circuit of further switching arrangements are schematically illustrated in the drawing outside of the device. Indeed, the current supply takes place through a contact strip in the support rail 7, which contact strip is conventional but is not illustrated for reasons of clarity.

The thread-breakage monitors 5 which are associated with each thread-delivery device are, viewed from the side of the person looking at the drawing, supported one behind the other on or in the support frame 1, such that they do not interfere with one another. Each thread-breaking monitor 5 has, aside from a long swivel arm 18, a short lever arm 19. The two arms 18 and 19 are connected with one another through a disk 20 which is supported rotatably in the support frame 1. The swivel arm 18 extends outside of the support frame 1 with a length which corresponds approximately with the length of the support rail 7. Arm 18 is bent at its free end and carries there a thread eyelet 21. The lever arm 19 is very short. Arm 19 projects slightly angled off from the disk 20 relative to the main direction of the swivel arm 18, and carries at its free end a contact piece 22. Same is placed on substance 23 through the short lever arm 19 and the disk 20. A return spring 25 engages the disk 20 eccentrically through a pin 24, the free end of which spring is held through a fastening means 26 on the support frame 1, wherein disk 20 and the arms 18–19 are resiliently urged counterclockwise in the drawing.

A first switch 27 is arranged in the support frame 1 in cooperation with the contact piece 22, which switch is part of the circuit 28 for the electromagnet 17. When the contact piece 22 rests on the switch 27, the circuit 28 is closed. Furthermore a second switch 29 for a cut-off circuit 30 for the knitting machine is arranged in the support frame 1 in such a manner that the contact piece 22 contacts it at a certain position of the thread-breakage monitor 5 to thereby stop the machine. A signalling lamp 31 is interconnected in the cut-off circuit 30.

OPERATION

The operation of the described thread-delivery device is discussed in connection with the thread-control device 4 and the thread-breakage monitor 5, which is shown in two different operating positions in the drawing. The course of the thread F which belongs to the thread-guiding roller 3 and the thread-control device 4 is drawn with a broken line, the thread $F_a$ which belongs to the thread-guiding roller 3*a* and the thread-control device 4*a* is drawn in a dash-dotted line, and the thread $F_b$ which belongs to the third thread-guiding roller 3*b* is illustrated with a dash-dotted line, however, without showing the thread-breakage monitors associated with the threads $F_a$ and $F_b$.

The thread F is supplied from a source, such as a conventional thread bobbin, through an inlet eyelet 32 to the thread-guiding roller 3. The thread after passing through eyelet 32, then passes through the eyelets 13 so as to be partially looped around the roller 3. This thread is partly processed on the knitting machine, and thus has a withdrawing tension which maintains the thread-breakage monitor 5 in the solid-line illustrated position against the force of the return spring 25.

The thread eyelet 21 is, in this position of the swivel arm 18, disposed between a first stationary guide eyelet 33 and a second stationary guide eyelet 34. The stationary guide eyelets for the threads $F_a$ and $F_b$ are, when viewed by an observer, arranged therebehind.

In the solid-line (i.e., the normal operating) position of the thread-breakage monitor 5, its contact piece 22 bears on the contact 27 and closes the circuit 28 for the electromagnet 17. Same attracts the arm 14 against the force of the spring 15 and thus holds the arms 10 of the thread-control element 9 in an operating position wherein the two eyelets 13 are disposed on substantially diametrically opposite sides of the thread-guiding roller 3 at the level of the area around which loops the delivery belt 8. The thread F is thus moved by the delivery belt 8 and is forwarded to the knitting machine. In the position illustrated in the drawing, a thread delivery does not take place on the thread-guiding rollers 3*a* and 3*b* since the associated swivel arms 10*a* and 10*b* are in a raised position in which the threads $F_a$ or $F_b$ are outside of the area of the delivery belt. The threads $F_a$ and $F_b$ are held in this position by the associated, not illustrated, springs 15*a* and 15*b*, since the circuits of the associated electromagnets are not closed. The associated tension sensing arms 18*a* and 18*b* (not shown) are in an inbetween position in which their associated contact pieces (equivalent to piece 22) are not in contact with the associated first switches (equivalent to switch 27), these latter contacts and switches being located behind the contact 22 and switch 27 and hence not illustrated for purposes of clarity.

In the case of a thread breakage between the processing point and the thread-delivery device, the thread-breakage monitor interrupts machine operation in the following manner: Due to the thread breakage, the tension in the unwinding thread F drops. This permits the return spring 25 to rotate the disk 20 (counterclockwise in the drawing) and to thus swivel the thread-breakage monitor 5. In this manner the connection between the contact piece 22 and the first switch 27 and thus the circuit 28 of the electromagnet 17 is interrupted immediately. Through this, the force of the spring 15 becomes effective, which suddenly swings the arm 14 and thus the arms 10 in the direction of the arrow A and thus immediately moves the eyelets 13 and with them the thread F upwardly into the delivery-belt-free area of the thread-guiding roller 3. The thread delivery is interrupted immediately. In the case of thread breakage, the tension drops to zero. This permits the return spring 25 to rotate the disk 20 so far that the contact piece 22 comes into contact with the second switch 29. The cut-off circuit 30 is thereby closed which turns off the knitting machine. At the same time the signalling lamp 31 lights up in order to indicate the break-down point. This position of the thread-breakage monitor 5 is illustrated in dashed lines in the drawing.

In the same manner, the thread-breakage monitor 5 also interrupts the thread delivery when the thread is not broken, but the tension in the unwinding thread is reduced. In stripe knitting machines, this is for example the case as soon as a thread change occurs at the processing point, whereby the thread F is there separated and clamped. The tension drop causes the arm 18 to swivel, whereby the circuit 28 of the electromagnet 17 is interrupted and the thread delivery is instantaneously interrupted. Of course, the swivel arm 18 reaches thereby only an inbetween or intermediate position in which the contact piece 22 is positioned between (and out of engagement with) the switches 27 and 29. In this inbetween position, arm 18 is held by a thread loop which its thread eyelet 21 has drawn between the stationary guide eyelets 33 and 34. Said loop absorbs the small amount of thread which was delivered after the thread change but prior to the interrupting of the delivery. In every case, the thread breakage monitor 5 differentiates between a thread breakage and a smaller tension drop caused by a thread change in the knitting machine, and switches off the knitting machine only in the first case. In both cases, however, it interrupts immediately the further delivery of thread from the respective delivery device.

The invention is not limited to the exemplary embodiment. Important is the switching of the electromagnet through the thread-breakage monitor and the sudden swivelling of the thread-control element out of the effective range of the delivery belt. This can be achieved also through a direct engagement of the electromagnet on an arm of magnetic material, which is biased for example through a counterweight toward its released position.

The thread-breakage monitor can also be constructed with one arm, with a contact piece at a small distance from its swivel bearing and coacting with correspondingly arranged switches.

Reference is made to my copending applications Ser. No. 051,188, filed June 22, 1979, and Ser. No. 068,320, filed concurrently herewith, the disclosures of which are incorporated herein by reference.

What is claimed is:

1. A positive thread-delivery device for a knitting machine, wherein a plurality of thread-guiding rollers are associated with each knitting system, with which one common delivery belt cooperates, wherein with each thread-guiding roller there is associated a thread-control element which, during the processing of the thread in the knitting machine, holds same in a clamping position between the delivery belt and the thread-guiding roller and which during paying out of the thread can be changed over into a position in which it guides the thread over an area of the thread-guiding roller which is free from the delivery belt to thus terminate such delivery, and including a thread-breakage monitor, comprising the improvement wherein a swivel arm is provided which engages the thread which unwinds from the thread-delivery device, which swivel arm has associated therewith first and second switches which are operated at different angles of traverse of the swivel arm, the first switch controlling an electromagnet which loads the thread-control element, the second switch stopping the drive of the machine, the first switch being the first one which is operated during swinging out of the swivel arm from a position assumed during thread delivery, and the second switch being the second one which is operated during swinging out of the swivel arm.

2. Device according to claim 1, wherein the swivel arm of the thread-breakage monitor rests during thread delivery on the first switch and closes the circuit of the electromagnet, and during the start of the swivelling movement interrupts the circuit.

3. Device according to claim 2, wherein when the circuit is closed, the electromagnet holds the thread-control element against the force of a spring which urges the thread-control element in a direction toward the delivery-belt-free area of the thread-guiding roller.

4. Device according to claim 3, wherein the spring is arranged at the free end of an arm which is connected to the thread-control element in its swivel area and the electromagnet is arranged opposite the arm.

5. Device according to claim 1, wherein the swivel arm of the thread-breakage monitor is connected to a rotatably supported and eccentrically spring-loaded disk and a short lever arm is arranged on same, which lever arm carries a contact piece at its free end.

6. Device according to claim 5, wherein the swivel arm has at its free end an eyelet for the unwinding thread.

7. Device according to claim 1, wherein several thread-delivery devices and associated thread-control elements with their thread-breakage monitors are supported on a common support frame for a knitting system of a knitting machine.

8. Device according to claim 7, wherein the thread-control elements are arranged movably elevationally on a common support rail which projects from the support frame, and the circuits to the associated electromagnets extend along this support rail.

9. Device according to claim 8, wherein stationary guide eyelets for each unwinding thread are mounted at the end of the support rail such that during delivery of the tensioned thread the thread eyelet of the swivel arm is positoned between them.

* * * * *